US012305657B1

(12) United States Patent
Kuang

(10) Patent No.: US 12,305,657 B1
(45) Date of Patent: May 20, 2025

(54) BIDIRECTIONAL BLOWING FIREPLACE FAN

(71) Applicant: Zhen Kuang, Jiangxi (CN)

(72) Inventor: Zhen Kuang, Jiangxi (CN)

( * ) Notice: Subject to any disclaimer, the term of this patent is extended or adjusted under 35 U.S.C. 154(b) by 0 days.

(21) Appl. No.: 18/946,862

(22) Filed: Nov. 13, 2024

(51) Int. Cl.
*F04D 25/16* (2006.01)
*F04D 29/38* (2006.01)
*F24B 1/188* (2006.01)

(52) U.S. Cl.
CPC ..... *F04D 25/16* (2013.01); *F04D 25/166* (2013.01); *F04D 29/386* (2013.01); *F24B 1/188* (2013.01)

(58) Field of Classification Search
CPC . F23F 2215/00; F23F 2250/08; F24B 1/1888; F04D 25/166; F04D 25/384; F04D 25/386; F04D 25/388; H05K 7/20172; H05K 7/20136; F01P 2005/025
USPC ..... 416/128, 235, 238
See application file for complete search history.

(56) References Cited

U.S. PATENT DOCUMENTS 5,597,034 A * 1/1997 Barker, III ..... H01L 23/467 174/16.3
2005/0145366 A1* 7/2005 Erel ..... H01L 23/467 257/E23.099
2018/0184547 A1* 6/2018 Tsai ..... H01L 23/473
2019/0242398 A1* 8/2019 Tripp ..... F04D 29/388

FOREIGN PATENT DOCUMENTS

CN 220186876 U 12/2023
WO 2014094213 A1 6/2014

* cited by examiner

*Primary Examiner* — Kenneth J Hansen

(57) ABSTRACT

A novel bidirectional blowing fireplace fan relates to the technical field of fireplace fan devices. A first motor and a second motor are arranged in a radiating bracket, the first motor and the second motor are respectively provided with a first fan blade and a second fan blade, and blowing directions of the first fan blade and the second fan blade are opposite. By arranging the wide radiating bracket and the fans blowing in opposite directions on both sides of the wide radiating bracket, bidirectional blowing is realized, so that heat is rapidly conducted in two directions at the same time; and meanwhile, power supply operation is carried out by using double thermoelectric generators, so that blowing is carried out more effectively, and heat-conducting efficiency is improved.

9 Claims, 5 Drawing Sheets

BIDIRECTIONAL BLOWING FIREPLACE FAN

TECHNICAL FIELD

The present invention relates to a novel bidirectional blowing fireplace fan and relates to the technical field of fireplace fan devices.

BACKGROUND OF THE PRESENT INVENTION

In order to make heat spread more quickly and evenly and improve a temperature rise rate in use, a fireplace fan is often used to blow air, so as to obtain a better temperature rise effect.

Existing fireplace fans have various forms, and fixing and mounting methods are also diversified, including a hanging type and an absorbing type. However, most of the existing fireplace fans are of single-fan structures. In order to improve blowing efficiency, a double-fan structure will be adopted to obtain a better heat diffusion effect by increasing a blowing intensity. However, whether the existing fireplace fans adopt single-fan or double-fans, they blow air in one direction only, and the heat can only be rapidly diffused in one direction, and a speed of heat-conducting from a position far from the fireplace to the surrounding of the fireplace is limited, which leads to limited heat-conducting effect of the fan. Therefore, a novel bidirectional blowing fireplace fan is provided to solve problems in the prior art.

SUMMARY OF THE PRESENT INVENTION

The present invention aims at providing a novel bidirectional blowing fireplace fan with respect to the defects or deficiencies in the prior art. By arranging a wide radiating bracket and fans blowing in opposite directions on both sides of the wide radiating bracket, bidirectional blowing can be realized, so that heat can be rapidly conducted in two directions at the same time, and meanwhile, power supply operation is carried out by using double thermoelectric generators, so that blowing can be carried out more effectively, and heat-conducting efficiency can be improved.

In order to achieve the above objects, the present invention adopts the following technical solutions: the novel bidirectional blowing fireplace fan comprises a radiating bracket 1, wherein a first motor 5 and a second motor 6 are arranged in the radiating bracket 1, a first fan blade 2 and a second fan blade 3 are respectively arranged on the first motor 5 and the second motor 6, and blowing directions of the first fan blade 2 and the second fan blade 3 are opposite.

Further, the first fan blade 2 has the same structure as the second fan blade 3, the first fan blade 2 comprises a fan blade bottom plate 2-1 and a spoiler 2-2, the fan blade bottom plate 2-1 is arranged in a horizontal plane and parallel to an end surface of the first motor 5, and the spoiler 2-2 is obliquely arranged at one side of the fan blade bottom plate 2-1.

Further, the radiating bracket 1 comprises a plurality of arc-shaped radiating fins 1-1, and two adjacent radiating fins 1-1 are connected through an isolation fin 1-6 to form a bottom heat-conducting cavity 1-7.

Further, a surface of the radiating fin 1-1 is provided with an arc-shaped convex radiating surface 1-11.

Further, a lower segment at a middle of the radiating bracket 1 is formed with a motor mounting cavity 1-5 through radiating fins 1-1.

Further, both sides of an inner wall of the motor mounting cavity 1-5 are provided with motor fixing grooves 1-4, and the motor fixing grooves 1-4 are matched with the first motor 5 and the second motor 6.

Further, atop of the motor mounting cavity 1-5 is provided with atop radiating plate 1-2.

Further, a bottom of the radiating bracket 1 is a bottom radiating plate 1-3, a bottom of the bottom radiating plate 1-3 is provided with a heat-conducting bracket 4, and the heat-conducting bracket 4 is an I-shaped bracket.

Further, a top of the heat-conducting bracket 4 is a top heat-conducting plate 4-1, and the top heat-conducting plate 4-1 is provided with a generator mounting groove 4-11.

Further, a first thermoelectric generator 7 and a second thermoelectric generator 8 are arranged in the generator mounting groove 4-11, and the first thermoelectric generator 7 and the second thermoelectric generator 8 are electrically connected with the first motor 5 and the second motor 6 respectively.

Further, a bottom of the heat-conducting bracket 4 is a fixed bottom plate 4-2, the fixed bottom plate 4-2 is connected with the top heat-conducting plate 4-1 through a supporting plate, and surfaces of the fixed bottom plate 4-2 and the supporting plate are provided with arc-shaped convex heat-conducting surfaces 4-3.

After employing the foregoing technical solutions, the present invention has the following beneficial effects. By arranging the wide radiating bracket and the fans blowing in the opposite directions on both sides of the wide radiating bracket, bidirectional blowing can be realized, so that the heat can be rapidly conducted in two directions at the same time, and meanwhile, power supply operation is carried out by using the double thermoelectric generators, so that blowing can be carried out more effectively, and the heat-conducting efficiency can be improved.

DESCRIPTION OF THE DRAWINGS

In order to illustrate the technical solutions in the embodiments of the present invention or in the prior art more clearly, the drawings used in the description of the embodiments or the prior art will be briefly described below. Obviously, the drawings in the following description are merely some embodiments of the present invention. For those of ordinary skills in the art, other drawings may also be obtained based on these drawings without going through any creative work.

Figure 1:
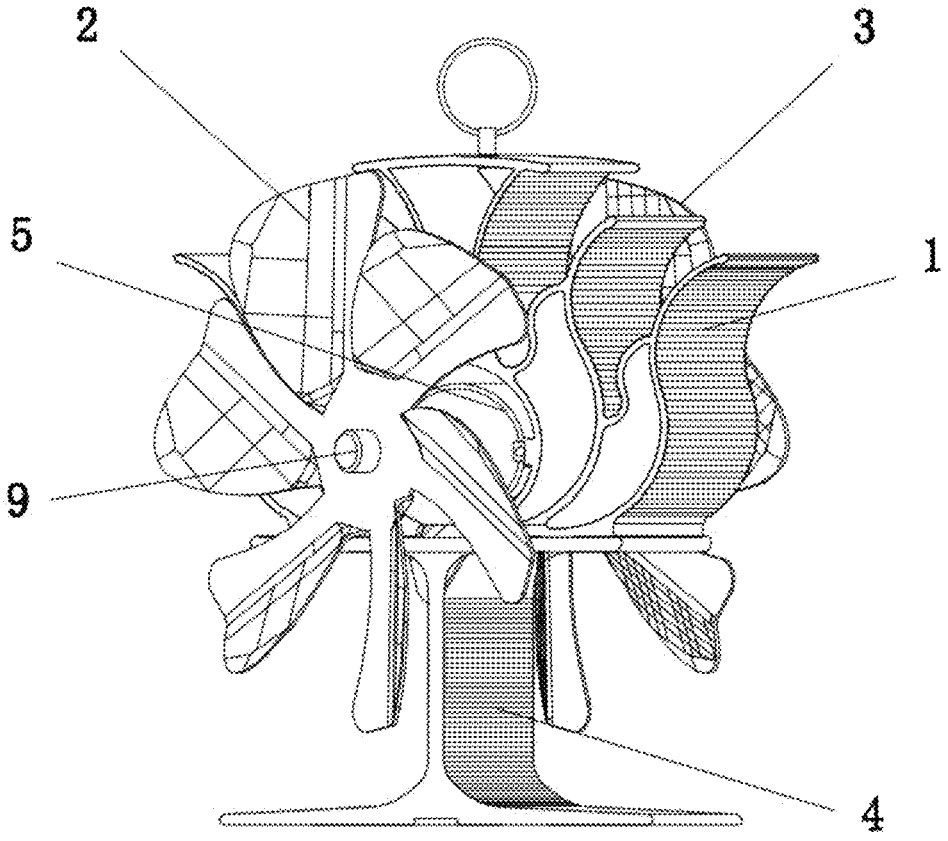
FIG. 1 is a schematic structural diagram of the present invention.

Description of the Reference numerals: 1 refers to radiating bracket, 2 refers to first fan blade, 3 refers to second fan blade, 4 refers to radiating bracket, 5 refers to first motor, 6 refers to second motor, 7 refers to first thermoelectric generator, 8 refers to second thermoelectric generator, 1-1 refers to radiating fin, 1-2 refers to top radiating plate, 1-3 refers to bottom radiating plate, 1-4 refers to motor fixing groove, 1-5 refers to motor mounting cavity, 1-6 refers to isolation fin, 1-7 refers to heat-conducting cavity, 1-11 refers to radiating surface, 2-1 refers to fan blade bottom plate, 2-2 refers to spoiler, 4-1 refers to top heat-conducting plate, 4-2 refers to fixed bottom plate, 4-3 refers to heat-conducting surface, and 4-11 refers to generator mounting groove.

DETAILED DESCRIPTION OF PREFERRED EMBODIMENTS

Figure 2:
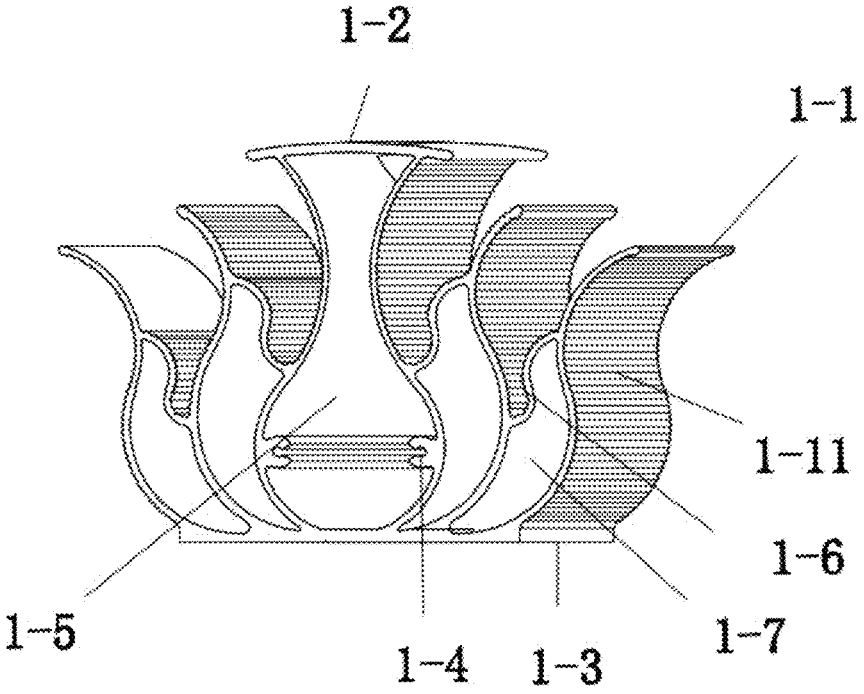
FIG. 2 is a schematic structural diagram of a radiating bracket in the present application.
Figure 3:
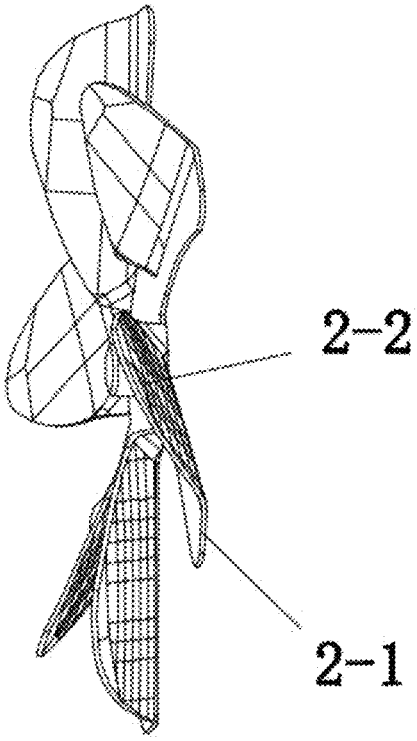
FIG. 3 is a schematic structural diagram of a first fan blade 2 in the present invention.
Figure 4:
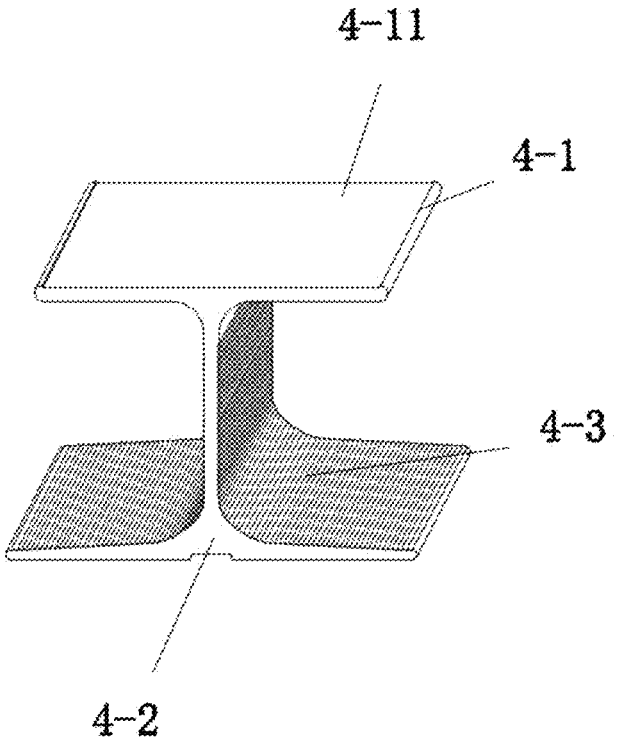
FIG. 4 is a schematic structure diagram of a heat-conducting bracket 4 in the present invention.
Figure 5:
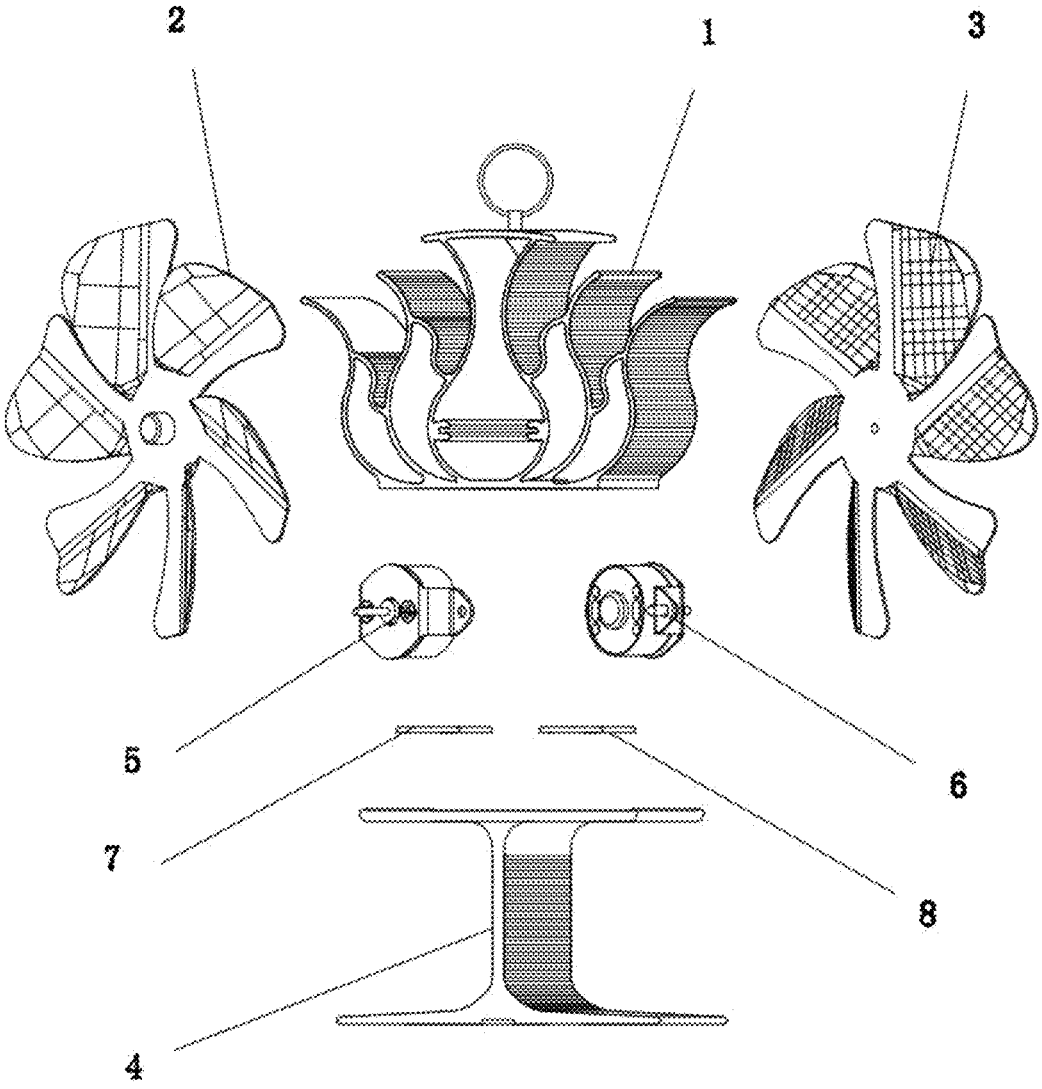
FIG. 5 is a schematic explosion structure diagram of the present invention.
Figure 6:
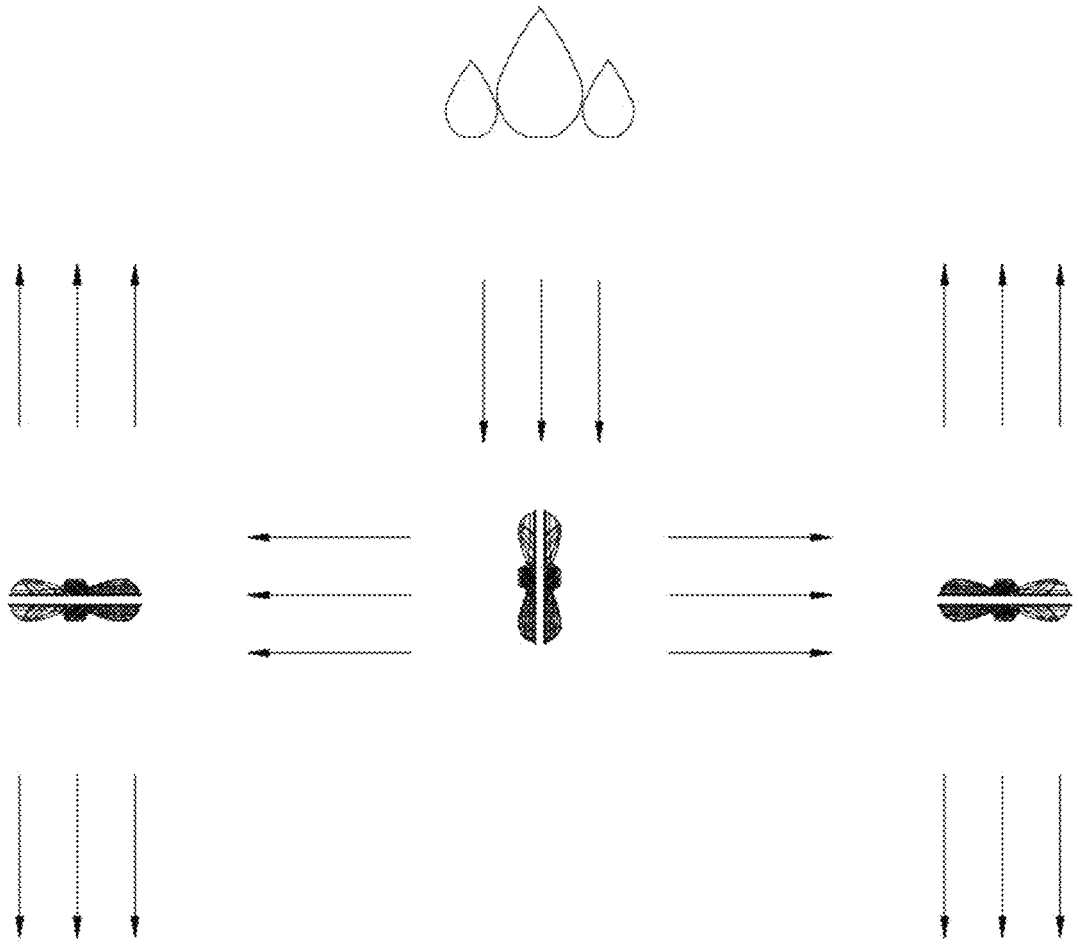
FIG. 6 is a schematic diagram of hot air diffusion of the present invention.

As shown in FIG. 1 to FIG. 6, the technical solutions employed in the embodiments are as follows: the novel bidirectional blowing fireplace fan comprises a radiating bracket 1, wherein a first motor 5 and a second motor 6 are arranged in the radiating bracket 1, a first fan blade 2 and a second fan blade 3 are respectively arranged on the first motor 5 and the second motor 6, and blowing directions of the first fan blade 2 and the second fan blade 3 are opposite. In this embodiment, two fans are driven by two motors respectively, and the blowing directions of the two fans are set in opposite directions, so that blowing in two directions can be realized. When the fans are placed at a front end of the hot air, the hot air can be quickly blown to both sides, so that the hot air can quickly spread horizontally to both sides of a space. If the use space is large, another two fans are vertically placed at both sides, so that the hot air can be further spread in a longitudinal direction, thereby effectively improving heat diffusion efficiency and bringing a better using effect to a user.

More specifically, the first fan blade 2 has the same structure as the second fan blade 3, the first fan blade 2 comprises a fan blade bottom plate 2-1 and a spoiler 2-2, the fan blade bottom plate 2-1 is arranged in a horizontal plane and parallel to an end surface of the first motor 5, and the spoiler 2-2 is obliquely arranged at one side of the fan blade bottom plate 2-1. In this embodiment, in order to prevent interference between the two fan blades during blowing, the fan blade bottom plate is horizontally arranged, so that the air does not need to be introduced from a rear side as in a traditional fan blade structure when rotating, while the spoiler is obliquely arranged, which can introduce the air from a side part, so that forward blowing can be realized without interference between the two fan blades, and a blowing effect is improved.

More specifically, the radiating bracket 1 comprises a plurality of arc-shaped radiating fins 1-1, and two adjacent radiating fins 1-1 are connected through an isolation fin 1-6 to form a bottom heat-conducting cavity 1-7. The arc-shaped radiating fins can improve a radiating area in a limited space, and are separated by the isolation fins, so that an upper open-type air inlet cavity and a lower heat-conducting cavity can better conduct air inlet and heat-conducting, and meanwhile, aesthetics of the novel bidirectional blowing fireplace fan is improved.

More specifically, a surface of the radiating fin 1-1 is provided with an arc-shaped convex radiating surface 1-11. By arranging the convex radiating surfaces on the radiating fins, a radiating effect can be further improved.

More specifically, a lower segment at a middle of the radiating bracket 1 is formed with a motor mounting cavity 1-5 through radiating fins 1-1, both sides of an inner wall of the motor mounting cavity 1-5 are provided with motor fixing grooves 1-4, and the motor fixing grooves 1-4 are matched with the first motor 5 and the second motor 6. The two motors are matched with the two fan blades to drive independently, and a driving effect is better.

More specifically, a top of the motor mounting cavity 1-5 is provided with a top radiating plate 1-2. In this embodiment, a handle is also provided on the top radiating plate to facilitate taking the fan.

More specifically, a bottom of the radiating bracket 1 is a bottom radiating plate 1-3, a bottom of the bottom radiating plate 1-3 is provided with a heat-conducting bracket 4, the heat-conducting bracket 4 is an I-shaped bracket, a top of the heat-conducting bracket 4 is a top heat-conducting plate 4-1, the top heat-conducting plate 4-1 is provided with a generator mounting groove 4-11, a first thermoelectric generator 7 and a second thermoelectric generator 8 are arranged in the generator mounting groove 4-11, and the first thermoelectric generator 7 and the second thermoelectric generator 8 are electrically connected with the first motor 5 and the second motor 6 respectively. By arranging the thermoelectric generator as an electric control structure, the temperature difference is used to generate electricity, and the greater the temperature difference is, the greater the generation power will be. When placing fans at different positions, fan speeds can be automatically controlled according to different temperatures, so that the heat diffusion is more uniform.

More specifically, a bottom of the heat-conducting bracket 4 is a fixed bottom plate 4-2, the fixed bottom plate 4-2 is connected with the top heat-conducting plate 4-1 through a supporting plate, and surfaces of the fixed bottom plate 4-2 and the supporting plate are provided with arc-shaped convex heat-conducting surfaces 4-3. By setting the convex heat-conducting surfaces, a heat-conducting speed can be improved and the power generating efficiency of the thermoelectric generator can be improved.

The working principle of the present invention is as follows: the first fan blade 2 and the second fan blade 3 are arranged on both sides of the radiating bracket 1, and the first motor 5 and the second motor 6 are respectively controlled by the first thermoelectric generator 7 and the second thermoelectric generator 8; after the fireplace is used, the two thermoelectric generators control the two motors to start and drive the two fans to rotate and blow. The greater the temperature difference is, the higher the output power is and the higher the blowing efficiency is, thus realizing automatic blowing. Because the first fan blade 2 and the second fan blade 3 are arranged in opposite directions, bidirectional blowing can be carried out, and when the blowing direction of the fan is not directly opposite to the fireplace, heat can be effectively blown to both sides, bidirectional blowing can be carried out, heat generate by the fireplace can be conducted more quickly, and a temperature of a use area can be rapidly increased.

Those described above are only used to illustrate the technical solutions of the present invention, rather than limiting the present invention. Other modifications or equivalent substitutions made by those of ordinary skills in the art to the technical solutions of the present invention should be included in the scope of the claims of the present invention as long as these modifications or equivalent substitutions do not deviate from the spirit and scope of the technical solutions of the present invention.

I claim:

1. A novel bidirectional blowing fireplace fan, comprising a radiating bracket (1), wherein a first motor (5) and a second motor (6) are arranged in the radiating bracket (1), a first fan blade (2) and a second fan blade (3) are respectively arranged on the first motor (5) and the second motor (6), and blowing directions of the first fan blade (2) and the second fan blade (3) are opposite, wherein the first fan blade (2) and the second fan blade (3) each comprise a fan blade bottom plate (2-1) and a spoiler (2-2), wherein each fan blade bottom plate (2-1) is arranged in a horizontal plane and parallel to an end surface of the first motor (5), and each spoiler (2-2) is obliquely arranged at one side of the fan blade bottom plate (2-1).

2. The novel bidirectional blowing fireplace fan according to claim 1, wherein the radiating bracket (1) comprises a plurality of arc-shaped radiating fins (1-1), and two adjacent radiating fins (1-1) are connected through an isolation fin (1-6) to form a bottom heat-conducting cavity (1-7).

3. The novel bidirectional blowing fireplace fan according to claim 2, wherein a surface of the radiating fin (1-1) is provided with an arc-shaped convex radiating surface (1-11).

4. The novel bidirectional blowing fireplace fan according to claim 1, wherein a lower segment at a middle of the radiating bracket (1) is formed with a motor mounting cavity (1-5) through radiating fins (1-1).

5. The novel bidirectional blowing fireplace fan according to claim 4, wherein both sides of an inner wall of the motor mounting cavity (1-5) are provided with motor fixing grooves (1-4), and the motor fixing grooves (1-4) are matched with the first motor (5) and the second motor (6).

6. The novel bidirectional blowing fireplace fan according to claim 4, wherein a top of the motor mounting cavity (1-5) is provided with a top radiating plate (1-2).

7. The novel bidirectional blowing fireplace fan according to claim 1, wherein a bottom of the radiating bracket (1) is a bottom radiating plate (1-3), a bottom of the bottom radiating plate (1-3) is provided with a heat-conducting bracket (4), the heat-conducting bracket (4) is an I-shaped bracket, a top of the heat-conducting bracket (4) is a top heat-conducting plate (4-1), and the top heat-conducting plate (4-1) is provided with a generator mounting groove (4-11).

8. The novel bidirectional blowing fireplace fan according to claim 7, wherein a first thermoelectric generator (7) and a second thermoelectric generator (8) are arranged in the generator mounting groove (4-11), and the first thermoelectric generator (7) and the second thermoelectric generator (8) are electrically connected with the first motor (5) and the second motor (6) respectively.

9. The novel bidirectional blowing fireplace fan according to claim 7, wherein a bottom of the heat-conducting bracket (4) is a fixed bottom plate (4-2), the fixed bottom plate (4-2) is connected with the top heat-conducting plate (4-1) through a supporting plate, and surfaces of the fixed bottom plate (4-2) and the supporting plate are provided with arc-shaped convex heat-conducting surfaces (4-3).

* * * * *